US007371983B1

(12) United States Patent
Lin et al.

(10) Patent No.: US 7,371,983 B1
(45) Date of Patent: May 13, 2008

(54) STRUCTURE OF FLEXIBLE ELEMENT

(75) Inventors: Ching-Hsin Lin, Taipei Hsien (TW); Wen-Hung Wu, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 0 days.

(21) Appl. No.: 11/802,207

(22) Filed: May 21, 2007

(51) Int. Cl.
*H01H 33/02* (2006.01)

(52) U.S. Cl. ..... 200/237; 200/553

(58) Field of Classification Search ..... 200/237, 200/553

See application file for complete search history.

(56) References Cited

U.S. PATENT DOCUMENTS 4,362,910 A 12/1982 Boebel et al.
4,551,592 A * 11/1985 Nishi et al. ..... 200/453
5,012,495 A * 4/1991 Munroe et al. ..... 337/3
6,542,125 B1 * 4/2003 Hoffmeister et al. ..... 343/702
7,259,343 B1 * 8/2007 Huang et al. ..... 200/553

* cited by examiner

*Primary Examiner*—Elvin Enad
*Assistant Examiner*—Lheiren Mae A. Anglo
(74) *Attorney, Agent, or Firm*—Muncy, Geissler, Olds & Lowe, PLLC

(57) ABSTRACT

A structure of a flexible element has a force-receiving portion and a fixing portion, wherein the force-receiving portion is extended to have two arms for connecting with the fixing portion, so as to form two bending portions therebetween, characterized in that an inner end point is defined inside the fixing portion and the inner edges of the fixing portion are extended from the inner edges of the bending portion and intersected at the inner end point, so that a force-distributing section is defined between the bending portion and the inner end point, for distributing the torque applied on the bending portion, so as to eliminate the problem of too much concentrated stress.

3 Claims, 5 Drawing Sheets

STRUCTURE OF FLEXIBLE ELEMENT

FIELD OF THE INVENTION

The present invention is related to a flexible element used in a switch, and more particularly to an improved flexible element for providing a flexibility of the switch.

BACKGROUND OF THE INVENTION

Different kinds of switches are suitable for different types of electronic devices or electric appliances, wherein some switches equip flexible element to define a pressing stress or a recovering flexibility, and further, the flexible element can be used as an electrical conducting media, such as disclosed in U.S. Pat. No. 4,362,910, entitled "Electrical Switch". In this patent, the flexible element is used as the contacting element, and through pressing the flexible element, two electrical terminals in the electronic switch can be connected and conducted. Please refer to FIGS. 1A and 1B. The conventional flexible element 9 includes a force-receiving portion 91, and a fixing portion 93, wherein the force-receiving portion 91 has two arms 92 extended therefrom to define two bending portions 94 between the force-receiving portion 91 and the fixing portion 93, so that the conventional flexible element 9 has a bent shape. Furthermore, the fixing portion 93 is fixed on one electrical terminal of the switch through two fixing openings 931 thereof, so that when pressing the force-receiving portion 91, it will move down to contact the other electrical terminal. However, the force suffered by the force-receiving portion 91 will produce a torque to apply on the bending portion 94 through the arms 92 with a length of L, such that partial stress will concentrated on the intersections of the inner edges of the bending portion and the inner edges 932 of the fixing portion. As shown in FIG. 1B, F1, F2 and F3 represent the forces suffered by each region, wherein F1>F2>F3, and F1 is far larger than F2, so that the bending portion 94 is easy to have metal fatigue or be broken owing to an exceeded force. Therefore, the stress distribution of the conventional flexible element 9 is urgent to be improved for prolonging the life time of the flexible element.

SUMMARY OF THE INVENTION

Consequently, in consideration of the metal fatigue and broken owing to too much concentrated stress, the object of the present invention is to provide an improved flexible element for avoiding the stress from being concentrated too much, so as to prolong the life time thereof.

The present invention is related to a structure of a flexible element having a force-receiving portion and a fixing portion, wherein the force-receiving portion is extended to have two arms for connecting with the fixing portion, so as to form two bending portions therebetween, the fixing portion is fixed on an electric terminal of a switch and is contacted with another electric terminal as being pressed to have a movement, characterized in that an inner end point is defined inside the fixing portion and the inner edges of the fixing portion are extended from the inner edges of the bending portion and intersected at the inner end point, so that a force-distributing section is defined between the bending portion and the inner end point, for distributing the torque applied on the bending portion, so as to eliminate the problem of too much concentrated stress and thus prolong the life time of the flexible element.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1A:
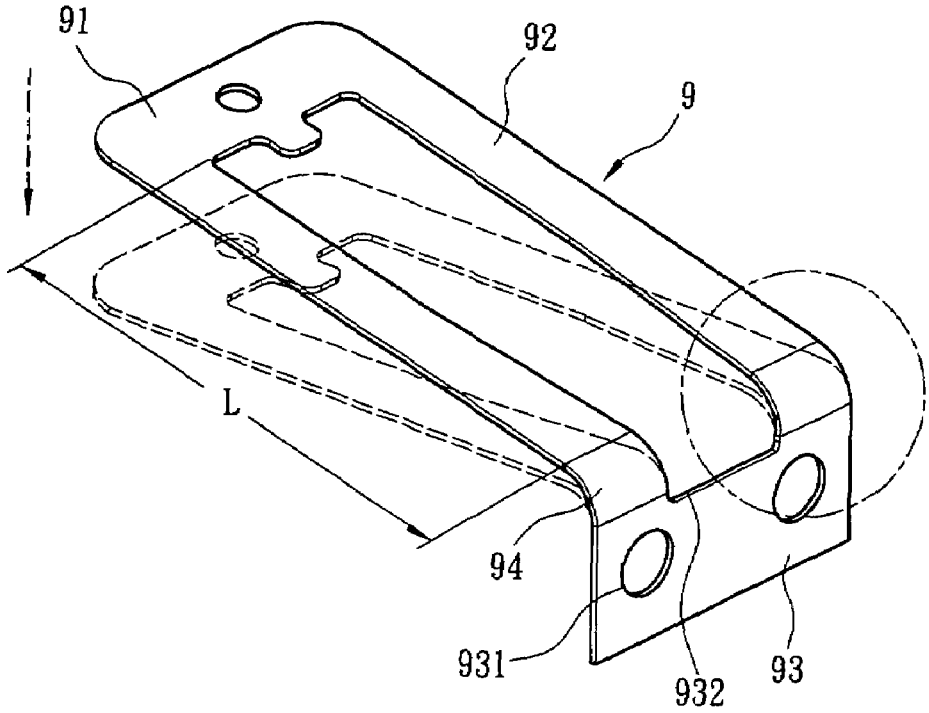
Fig. 1A PRIOR ART
FIG. 1A is a schematic view showing a conventional flexible element.
Figure 1B:
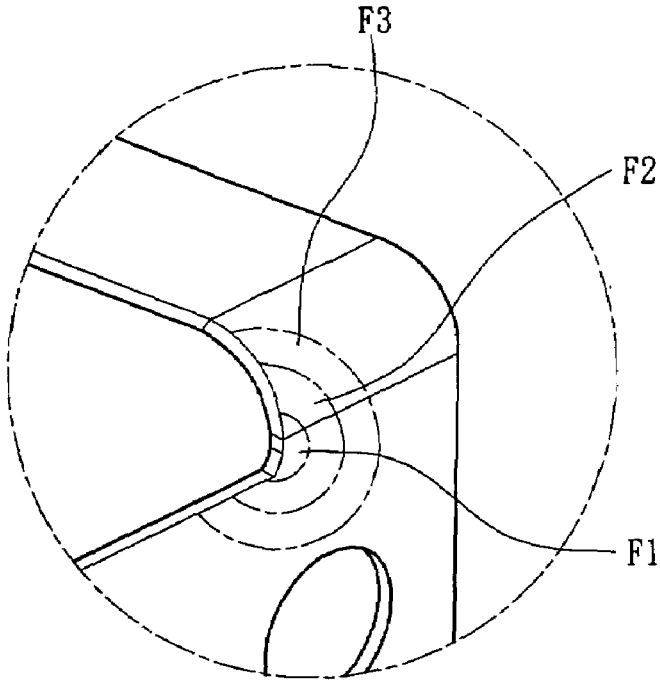
Fig. 1B PRIOR ART
FIG. 1B is a partial magnified drawing showing a conventional flexible element.
Figure 2:
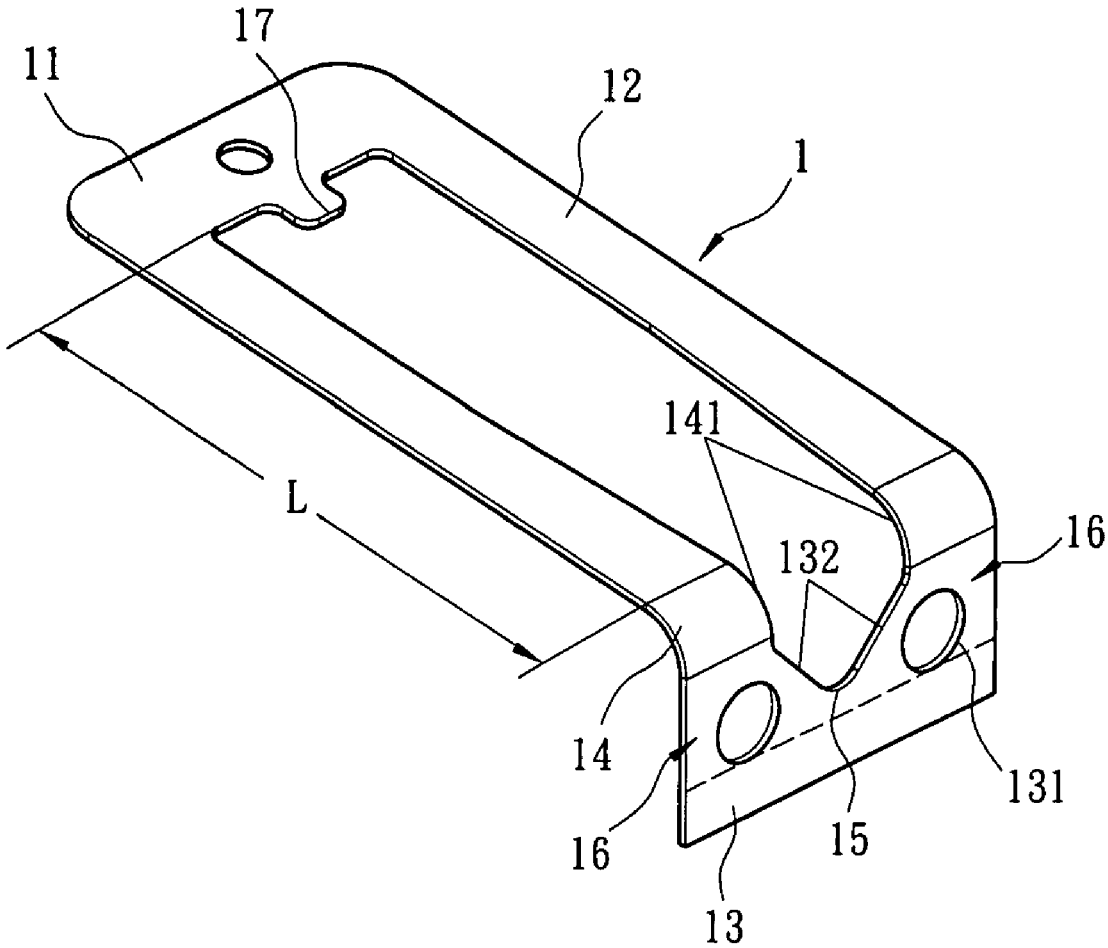
FIG. 2 is a three-dimensional drawing showing the present invention.

Please refer to FIG. 2, which shows a three-dimensional drawing of a flexible element 1 according to the present invention. The flexible element 1 includes a force-receiving portion 11, a fixing portion 13, and a bending portion 14, wherein the force-receiving portion 11 has two arms 12 with a length of L extended therefrom to connect with the fixing portion 13, so as to form the bending portion 14 therebetween. The fixing portion 13 can further have one or more than one fixing openings 131, for connecting with electrical terminal. Moreover, the inner edge of the force-receiving portion 11 has a buckle 17 mounted thereon for connecting and positioning. The flexible element 1 further has an inner end point 15, and the inner edges 132 of the fixing portion 13 are extended from the inner edges 141 of the bending portion 14 and are intersected at the inner end point 15, such that the fixing portion-inner edges 132 will have an identical length, and the fixing portion-inner edge 132 and the bending portion-inner edge 141 are included to have an angle larger than 90°. Here, the portion between the bending portion 14 and the inner end point 15 are defined to be a force-distributing section 16, so that as the bending portion 14 is regarded as a turning point, then the torque caused by pressing the force-receiving portion 11 through the arms 12 can be distributed at the force-distributing section 16, thereby avoiding from generating stress concentration point and thus prolonging the life time of the flexible element.

Figure 3:
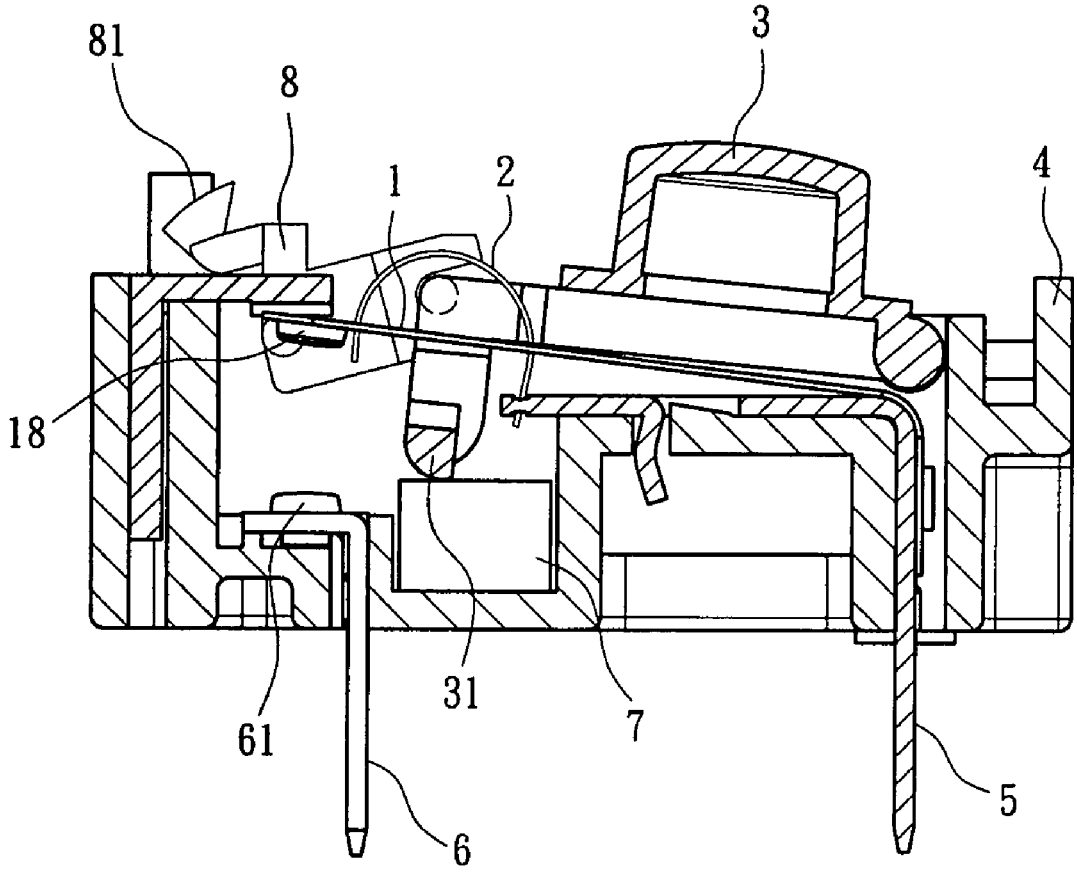
FIG. 3 is a schematic view showing an application in a first state according to the present invention.
Figure 4:
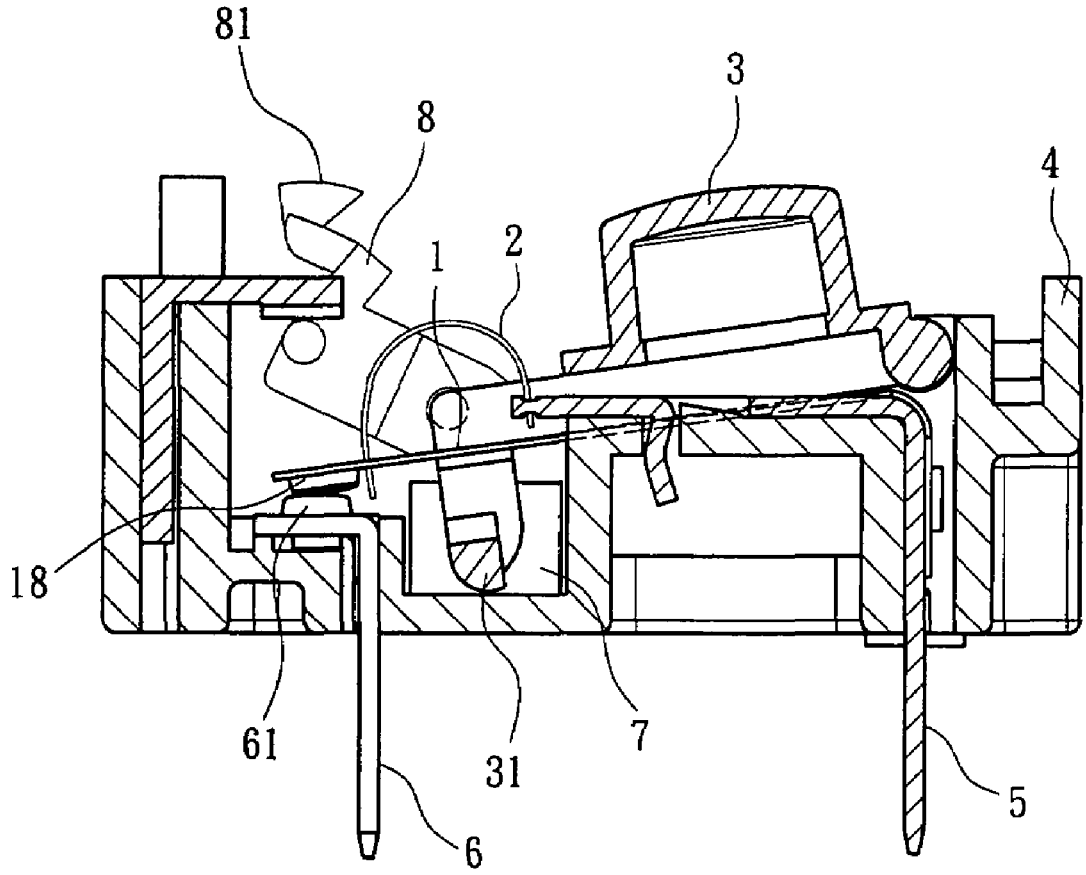
FIG. 4 is a schematic view showing an application in a second state according to the present invention.

Please refer to FIGS. 3 and 4, which show an application of the flexible element according to the present invention, in which the flexible element 1 is applied to a switch. The switch includes an outer housing 4, a button portion 3, a positioning element 2, a first conducting element 5, a second conducting element 6, a sliding block 7, and a linkage element 8, wherein the first conducting element 5 and the second conducting element 6 are embedded in two sides of the switch, the fixing portion 13 of the flexible element 1 is fixed on the first conducting element 5, the positioning element 2 is mounted between the first conducting element 5 and the flexible element 1, the force-receiving portion 11 of the flexible element 1 has a contacting point 18, the button portion 3 is located above the flexible element 1, the button portion 3 has a rejecting lever 31, the sliding block 7 is located under the rejecting lever 31, and the button portion 3 is connected to the linkage element 8. When the button portion 3 is pressed down, the rejecting lever 31 moves downward to push the sliding block 7, so as to move the adjacent switch. The position of the linkage element 8 is changed by the press on the button portion 3, so that a status displaying block 81 at one end of the linkage element 8 will be moved to show the statuses of the switch. The button portion 3 also presses on the flexible element 1 for bending the flexible element 1, such that the contacting point 18 of the flexible element 1 will contact with a contacting point 61 of the second conducting element 6, thereby a conduction between the first conducting element 5 and the second conducting element 6 is formed for achieving the purposes of turning on or off the electronic device.

Figure 5A:
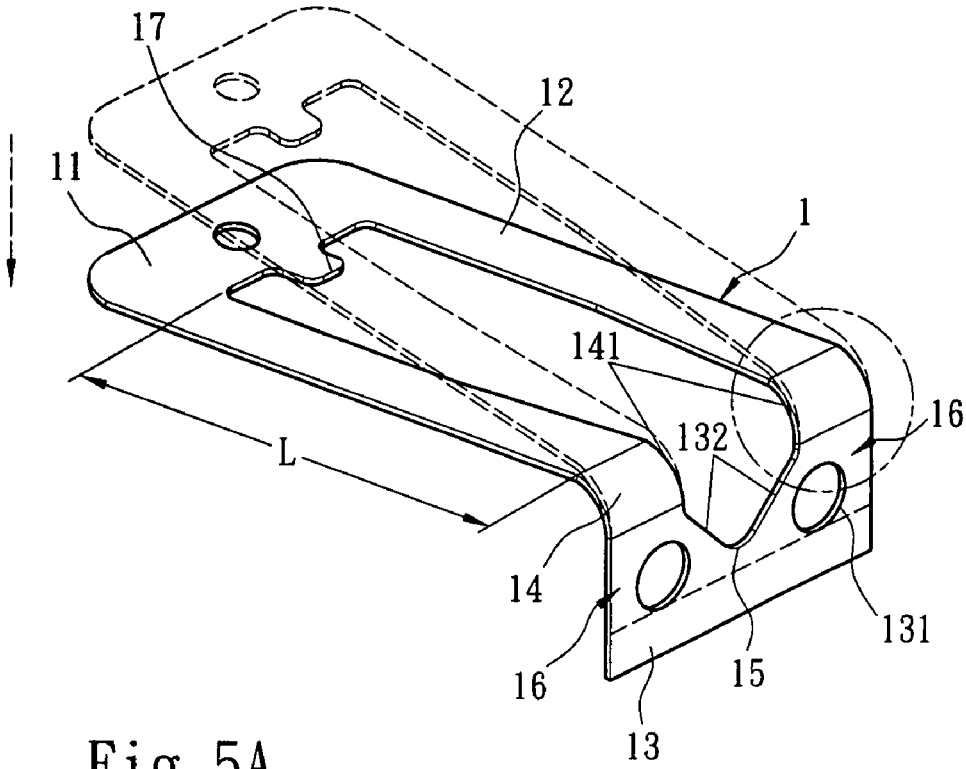
FIG. 5A is a schematic view showing the pressing applied on the present invention.
Figure 5B:
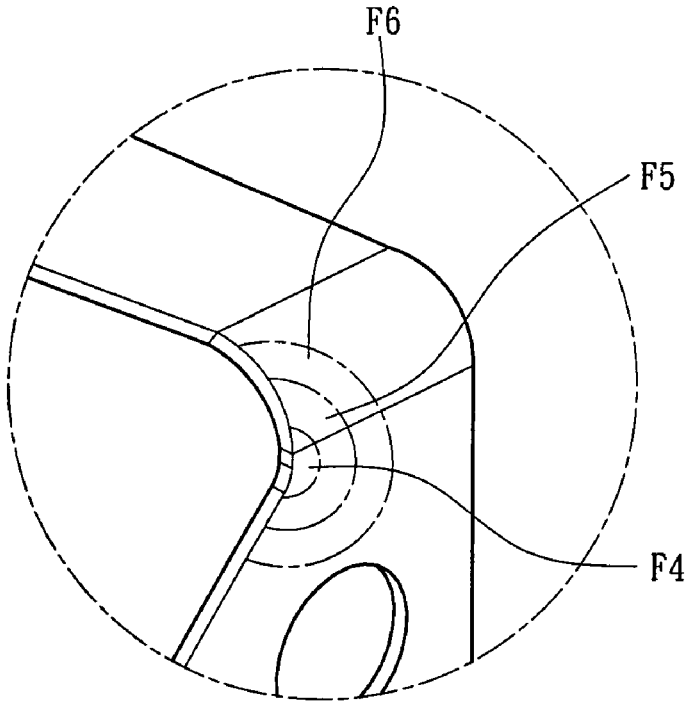
FIG. 5B is a partial magnified drawing showing a bending portion of the present invention.

Please further refer to FIG. 5A. According to the application of the flexible element 1 in a switch described above, the force-receiving portion 11 will be constantly pressed owing to the frequent switching on and off. The downward pressure suffered by the force-receiving portion 11 forms a torque on the bending portion 14 through the arms 12 with a length of L. Since the force-distributing section 16 can share the torque applied on bending portion 14, the bending portion-inner edges 141 and the fixing portion-inner edges 132 are formed to have a smooth bending, so that the stress concentration point between the bending portion 14 and the fixing portion 13 can be eliminated, thereby the bending portion 14 and the force-distributing section 16 can averagely distribute the stress. Please refer to FIG. 5B. As shown, F4, F5 and F6 are respectively represent the applied forces on each region, wherein F4≈F5≈F6, such that the stress distributed on each region are approximately identical, thereby slowing down the metal fatigue and also prolonging the life time of the flexible element 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A structure of a flexible element having a force-receiving portion and a fixing portion, wherein the force-receiving portion has two arms extended therefrom to connect with the fixing portion so as to form two bending portions therebetween, and the fixing portion is fixed at an electrical terminal of a switch, so that when the force-receiving portion is pressed, a bending torque produced through the arms between the force-receiving portion and the bending portion makes a contacting point of the force-receiving portion to contact with another electrical terminal of the switch, thereby electrically connecting the two electrical terminals, characterized in that:

an inner end point is defined inside the fixing portion, and inner edges of the fixing portion are extended from inner edges of the bending portion and intersected at the inner end point, thereby a force-distributing section is defined between the bending portion and the inner end point so as to distribute the torque suffered by the bending portion.

2. The structure as claimed in claim 1, wherein the inner edges of the fixing portion between the inner end point and the bending portion have an identical length.

3. The structure as claimed in claim 1, wherein the inner edges of the bending portion and the inner edges of the fixing portion are included to have an angle larger than 90°.

* * * * *